US006541899B1

(12) United States Patent
Haverlag et al.

(10) Patent No.: US 6,541,899 B1
(45) Date of Patent: Apr. 1, 2003

(54) DISCHARGED LAMP WITH MULTIPLE ELECTRON EMISSIVE ELECTRODE BODIES

(75) Inventors: Marco Haverlag, Eindhoven (NL); Jean Johan Heuvelmans, Eindhoven (NL); John Fitzgerald, Turnhout (BE); Andreas Sebastianus Gertrudis Geven, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 164 days.

(21) Appl. No.: 09/702,911

(22) Filed: Oct. 30, 2000

(30) Foreign Application Priority Data

Nov. 2, 1999 (EP) ..... 99203606

(51) Int. Cl.[7] ..... H01J 1/88

(52) U.S. Cl. ..... 313/272; 313/491; 313/631; 313/633

(58) Field of Search ..... 313/491, 574, 313/631, 633, 272

(56) References Cited

U.S. PATENT DOCUMENTS

| | | | | |
|---|---|---|---|---|
| 2,312,245 A | | 2/1943 | Flaws | 176/126 |
| 3,710,172 A | | 1/1973 | Witting | 313/338 |
| 3,919,579 A | | 11/1975 | Lemmers | 313/273 |
| 4,734,616 A | * | 3/1988 | Northrop | 313/492 |

FOREIGN PATENT DOCUMENTS

| | | | |
|---|---|---|---|
| EP | 0376173 A2 | 7/1990 | H05B/41/232 |
| EP | 0491420 A1 | 6/1992 | H01J/61/56 |

* cited by examiner

*Primary Examiner*—Vip Patel
(74) *Attorney, Agent, or Firm*—Dicran Halajian

(57) ABSTRACT

In a lighting arrangement comprising a low-pressure discharge lamp and a high-frequency ballast for cold-igniting and operating the low-pressure discharge lamp, said low-pressure discharge lamp is equipped with electrodes which each comprise two or more double-spiral tungsten electrode bodies covered with an emitter. The switching performance of the low-pressure discharge lamp is very high.

11 Claims, 3 Drawing Sheets

DISCHARGED LAMP WITH MULTIPLE ELECTRON EMISSIVE ELECTRODE BODIES

BACKGROUND OF THE INVENTION

1. Field of the Invention

The invention relates to a lighting system comprising a low-pressure discharge lamp provided with a discharge vessel which is closed in a gastight manner and contains an ionizable filling, which low-pressure discharge lamp is further provided with electrodes for maintaining an electric discharge in the discharge vessel, which electrodes are provided with a first electrode body of a refractory metal which is electrically connected to current conductors which extend from the interior of the discharge vessel to the exterior, which first electrode body is at least partly covered with an electron-emitting material, and a ballast circuit, which is connected to the current conductors, and which serves to cold ignite the low-pressure discharge lamp and to feed a high-frequency lamp current to the low-pressure discharge lamp.

2. Description of the Prior Art

Such a lighting system is disclosed in EP 0491420 A1. As a result of the cold ignition of the low-pressure discharge lamp by the ballast circuit, the low-pressure discharge lamp ignites very rapidly and the ballast circuit is comparatively simple and hence inexpensive. A drawback of the cold ignition of the low-pressure discharge lamp resides in that the switching performance, i.e. the number of times that the low-pressure discharge lamp can be switched on is relatively small. This is caused by the fact that during igniting a glow discharge develops, under the influence of the high-frequency voltage across the low-pressure discharge lamp, which glow discharge strikes only a part of the electrode body. This electrode body is generally formed in practice by a double spiral. As a result, this part of the electrode body is so intensively bombarded with positive ions that sputtering of the refractory metal takes place. This sputtering eventually causes a break in the electrode body, which means the end of the service life of the low-pressure discharge lamp.

SUMMARY OF THE INVENTION

It is an object of the invention to provide a lighting system wherein the low-pressure discharge lamp is cold ignited by the ballast circuit, and the switching performance of the low-pressure discharge lamp is comparatively high.

To achieve this, a lighting system as mentioned in the opening paragraph is characterized in accordance with the invention in that at least one of the electrodes is provided with a second electrode body of a refractory metal, which is electrically connected to the current conductors and which is at least partly covered with an electron-emitting material.

The presence of the second body enables the total amount of electron-emitting material necessary to maintain the discharge during stationary lamp operation to be distributed over the two electrode bodies. As a result, the temperature distribution over the electrode bodies during igniting the low-pressure discharge lamp is much more homogeneous than the temperature distribution over the electrode body of the electrode in the low-pressure discharge lamp of the known lighting system. By virtue of this more homogeneous temperature distribution, the glow discharge, which occurs during the ignition, does not always strike at the same location. As a result, also the sputtering of refractory material is more evenly distributed over the electrode (or over the electrode bodies). By virtue of the latter, a break in the electrode only occurs after the low-pressure discharge lamp has been ignited a comparatively large number of times.

In most cases, the low-pressure discharge lamp is provided with two electrodes. In order to extend the service life of each of these electrodes, each electrode is preferably provided with a second electrode body of a refractory metal, which is electrically connected to the current conductors and at least partly covered with an electron-emitting material.

In some cases it may be desirable to further improve the homogeneity of the temperature distribution by providing at least one of the electrodes with three or more electrode bodies of a refractory metal, which are electrically connected to the current conductors and at least partly covered with an electron-emitting material.

Good results have been achieved with lighting systems in accordance with the invention wherein each of the electrode bodies connects two current conductors with each other. The electrode bodies are connected in parallel. Apart from a more homogeneous temperature distribution, it is achieved that, in case of breakage of one of the electrode bodies, at least one electrode body remains, so that the electrode can remain functional.

Good results have also been achieved with embodiments of a lighting system in accordance with the invention wherein the first and the second electrode body are each formed by a double spiral of refractory material, which is at least partly covered with an electron-emitting material. This double spiral is formed by winding a wire, wound in the form of a first spiral (the primary winding), into the form of a second spiral (the secondary winding). More particularly it has been found that a good homogeneity of the temperature distribution can be brought about if the secondary winding of the double spiral of each electrode body comprises at least 8 turns. Since there are at least 8 turns between two current conductors, the temperature distribution over these 8 turns is very homogeneous.

In a preferred embodiment of a lighting system in accordance with the invention, the lighting system is a compact fluorescent lamp comprising a housing which is secured to the low-pressure discharge lamp, the ionizable filling containing mercury and at least an inert gas, the discharge vessel being provided at an inner surface with a luminescent layer, the housing also being secured to a lamp cap having contacts, and the ballast circuit being accommodated in the housing and being electrically connected to the contacts and the current conductors.

These and other aspects of the invention will be apparent from and elucidated with reference to the embodiment(s) described hereinafter.

DETAILED DESCRIPTION

Figure 1:
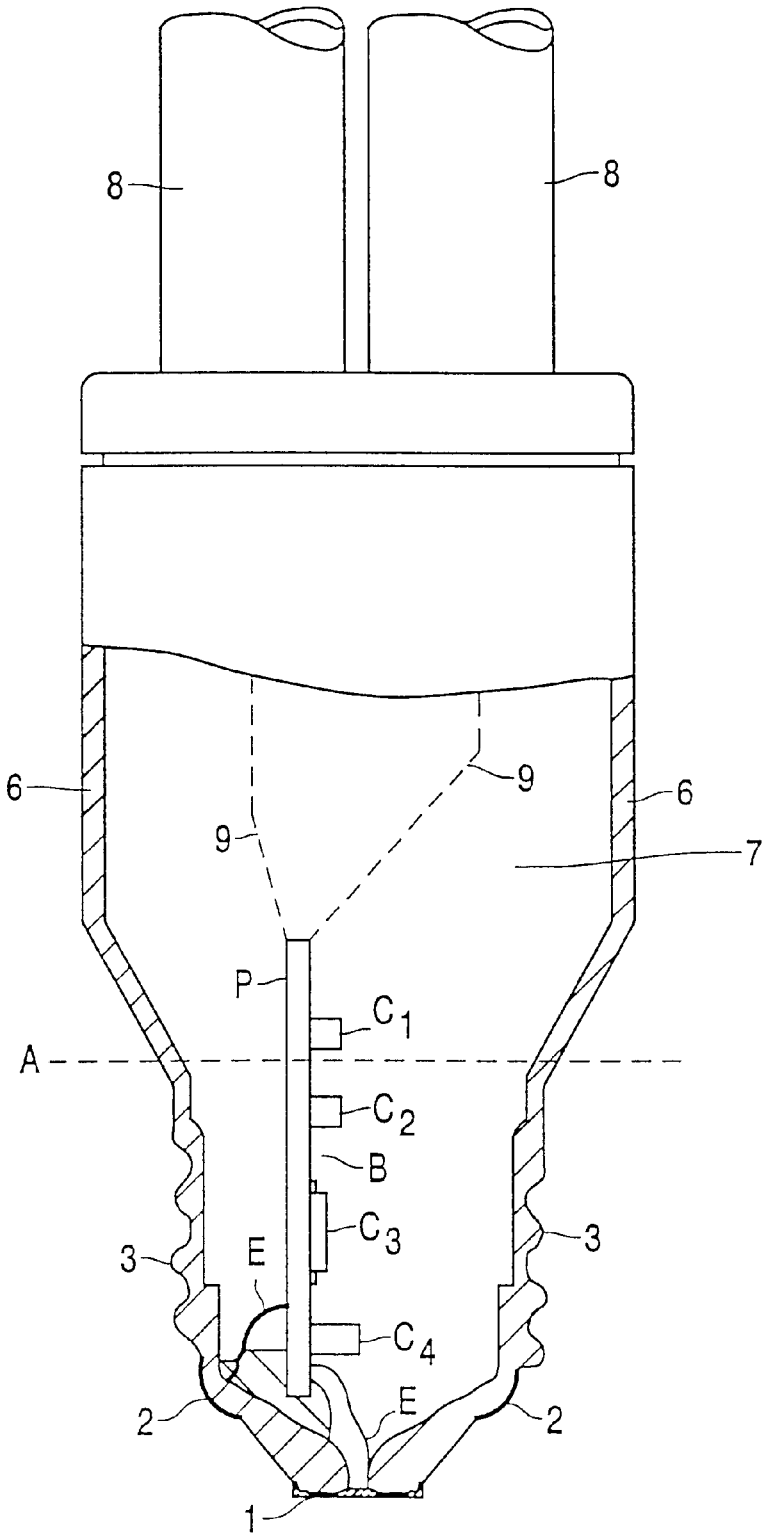
FIG. 1 shows an example of a lighting system in accordance with the invention, wherein the lighting system is a compact fluorescent lamp.

In FIG. 1, reference numeral 8 denotes a low-pressure discharge lamp comprising a filling containing mercury and an inert gas and two electrodes (not shown). A luminescent layer is applied to the wall of the discharge vessel. Reference numeral 6 denotes a housing which is se cure d to the low-pressure discharge lamp 8. Reference numeral 3 denotes a lamp cap provided with contacts (1 and 2) and secured to the housing. Circuit parts P and C1–C4 schematically represent a ballast circuit for the cold ignition of the low-pressure discharge lamp and for feeding a high-frequency lamp current to the low-pressure discharge lamp. The ballast circuit is electrically connected to the contacts via the conductors E and to the current conductors 9.

Figure 2:
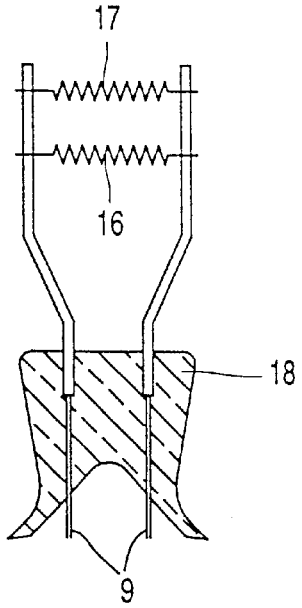
FIG. 2 shows a first embodiment of an electrode which can be used in the low-pressure discharge lamp of the lighting system shown in FIG. 1.

In FIG. 2, reference numerals 16 and 17 denote, respectively, a first and a second electrode body of a refractory metal, which are electrically connected to the current conductors 9 and at least partly covered with an electron-emitting material. In this embodiment of the electrode, the electrode bodies are formed by a double spiral. Reference numeral 18 denotes the stem. The stem is the part of the wall of the lamp vessel where the current conductors are passed through. In practice, a first current conductor of the first lamp electrode is connected via a capacitor to a first current conductor of the second lamp electrode, and a second current conductor of the first lamp electrode is connected in series with a coil. During the ignition, a high voltage is generated across the capacitor and hence across the low-pressure discharge lamp by a high-frequency current flowing through the capacitor and the coil. This current also flows through the current conductors and the electrode bodies. In the embodiment of the electrode shown in FIG. 2, each of the electrode bodies connects the two current conductors to each other. Only if both electrode bodies are no longer electroconductive as a result of a break, the current necessary to ignite the low-pressure discharge lamp can no longer flow, so that the low-pressure discharge lamp cannot be ignited anymore.

Figure 3:
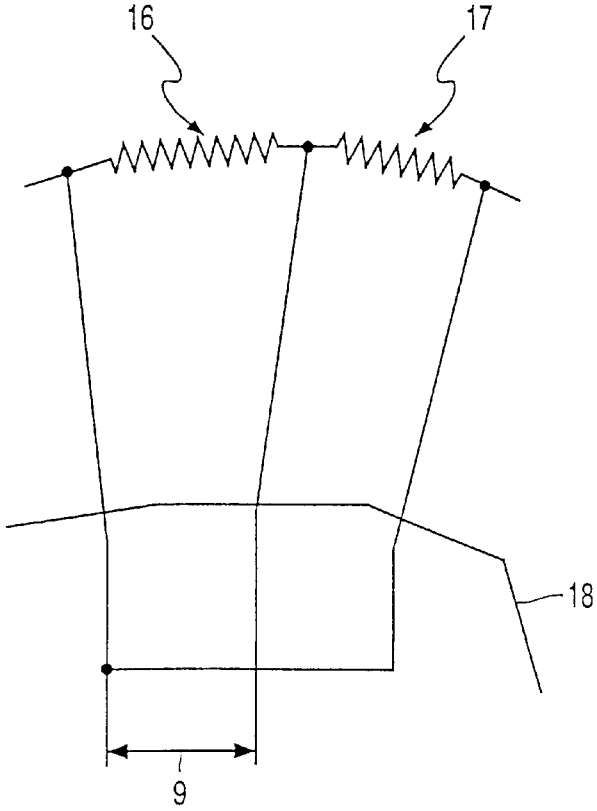
FIG. 3 shows a second embodiment of an electrode which can be used in the low-pressure discharge lamp of the lighting system shown in FIG. 1.

In FIG. 3, reference numerals 16 and 17 also denote, respectively, a first and a second electrode body of a refractory metal, which are electrically connected to the current conductors 9 and at least partly covered with an electron-emitting material. In this embodiment of the electrode, the electrode bodies are formed by a double spiral. Reference numeral 18 denotes the stem. In the embodiment shown in FIG. 3, use is made of three current conductors. By virtue thereof, the angle between the electrode bodies 16 and 17 can be chosen to be smaller than 180 degrees, so that the electrode has a smaller diameter. In order to be able to ignite the lamp, the current conductors issuing from the lamp vessel are often connected to a capacitor and a coil in the same manner as indicated above in the description of FIG. 2. With respect to the embodiment of an electrode shown in FIG. 3, it also applies that only after each of the electrode bodies has become non-conducting due to breakage, the low-pressure discharge lamp cannot be ignited anymore.

Figure 4:
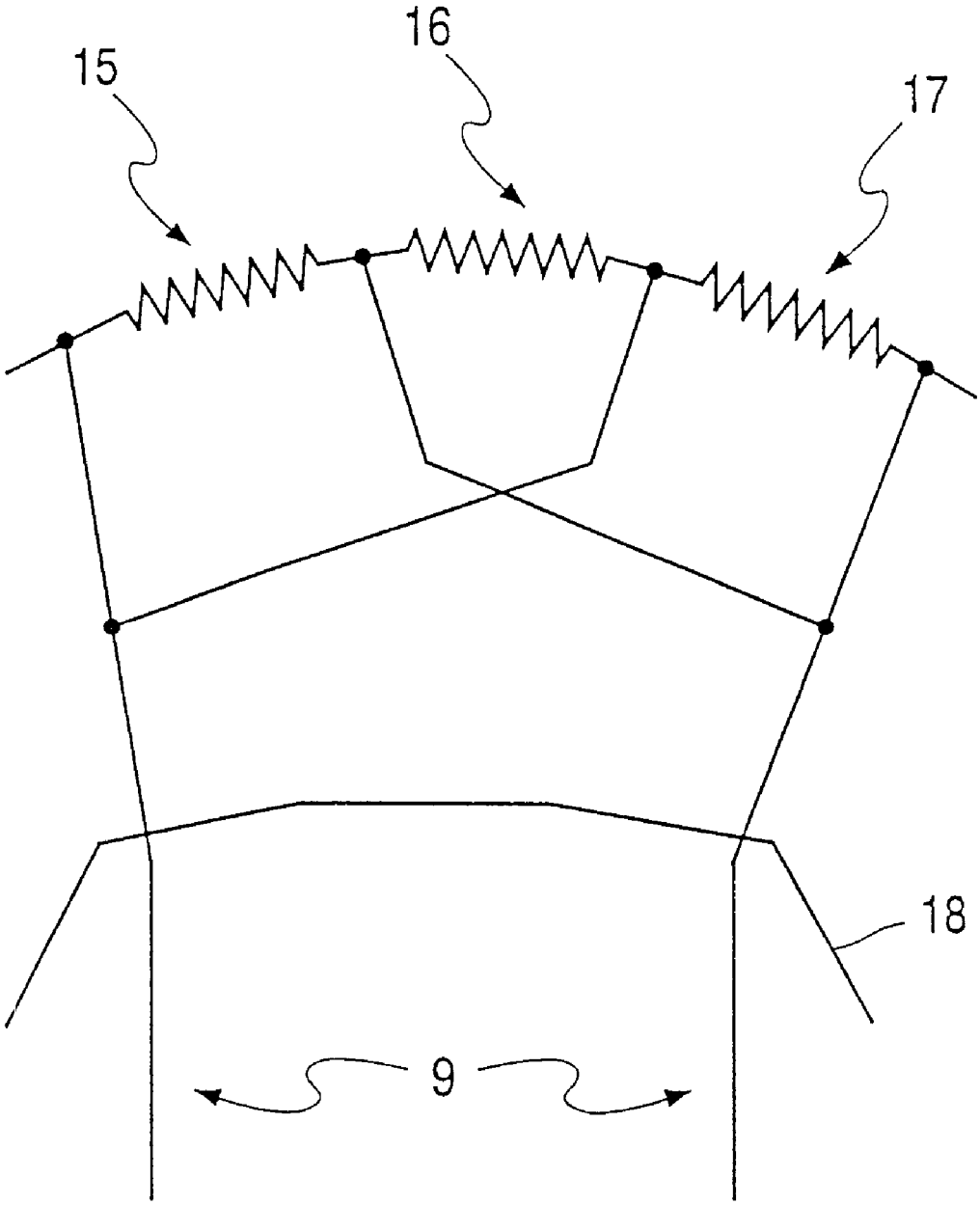
FIG. 4 shows a third embodiment of an electrode which can be used in the low-pressure discharge lamp of the lighting system shown in FIG. 1.

FIG. 4 shows an embodiment of an electrode that is very similar to the embodiment shown in FIG. 3. 15, 16, and 17 are electrode bodies formed by a double spiral. They are at least partly covered with an electron-emitting material. Reference numeral 18 denotes the stem and 9 are current conductors. Only when all three electrode bodies are broken, the low-pressure discharge lamp cannot be ignited anymore.

In a practical embodiment of a lighting system in accordance with the invention, a compact fluorescent lamp was provided with electrodes which each comprise three electrode bodies. Each of the electrode bodies is in the form of a double spiral formed from a tungsten wire and covered with an emitter containing BaO, SrO, CaO and Zr. It has been found that the switching performance of this compact fluorescent lamp is 50% higher than that of a conventional compact fluorescent lamp wherein the electrodes each comprise only one electrode body consisting of a triple spiral with as many secondary windings and primary windings as the three double spirals in an electrode of the practical embodiment combined. The switching performance is regarded as the number of ignitions of the low-pressure discharge lamp before one of the bodies demonstrates a break. If the switching performance is regarded as the number of ignitions of the low-pressure discharge lamp before all three electrode bodies of one of the electrodes demonstrate a break, then the switching performance is 360% higher than that of the conventional compact fluorescent lamp.

What is claimed is:

1. A lighting system comprising:

a low-pressure discharge lamp provided with a discharge vessel which is closed in a gastight manner and contains an ionizable filling, which low-pressure discharge lamp is further provided with at least first and second electrodes for maintaining an electric discharge in the discharge vessel wherein the first electrode is provided with first and second electrode bodies of a refractory metal which are at least partly covered with an electron-emitting material, said first electrode being fed by current conductors which after passing through a stem extend into said discharge lamp along a first direction, said first and second electrode bodies being parallel to each other and being connected between said current conductors at different distances from said stem along said first direction; and a ballast circuit which is connected to the current conductors, and which serves to cold ignite the low-pressure discharge lamp and to feed a high-frequency lamp current to the low-pressure discharge lamp.

2. A lighting system as claimed in claim 1 wherein the first and the second electrode body are each formed by a double spiral of refractory material, which is at least partly covered with an electron-emitting material.

3. A lighting system as claimed in claim 2, wherein a secondary winding of the double spiral of each electrode body comprises at least 8 turns.

4. A lighting system as claims in claim 1 wherein the lighting system is a compact fluorescent lamp comprising a housing which is secured to the low-pressured discharge lamp, the ionizable filling containing mercury and at least an inert gas, the discharge vessel being provided at an inner surface with a luminescent layer, the housing also being secured to a lamp cap having contacts, and the ballast circuit being accommodated in the housing and being electrically connected to the contacts and the current conductors.

5. A lighting system as claimed in claim 1, wherein said second electrode is provided with third and fourth electrode bodies of a refractory metal which are at least partly covered with an electron-emitting material.

6. A lighting system comprising:

a low-pressure discharge lamp provided with a discharge vessel which is closed in a gastight manner and contains an ionizable filling, which low-pressure discharge lamp is further provided with at least first and second electrodes for maintaining an electric discharge in the discharge vessel wherein the first electrode is provided with first and second electrode bodies of a refractory metal which are at least partly covered with an electron-emitting material, said first electrode being fed by current conductors and said first and second electrode bodies being connected between said current conductors and being disposed at an angle with respect to each other of other than 0° or 180°.

7. A lighting system as claimed in claim 6, wherein the second electrode is provided with third and fourth electrode bodies of a refractory metal which are at least partly covered with an electron-emitting material.

8. A lighting system as claimed in claim 6, wherein at least one of the electrodes is provided with a third body of refractory metal, which is electrically connected to the current conductors and at least partly covered with an electron-emitting material wherein each of the first, second, and third electrode bodies are disposed an at angle with respect to the other two electrode bodies of other than 0° or 180°.

9. A lighting system as claimed in claim 6, wherein the first and the second electrode bodies are each formed by a double spiral of refractory material, which is at least partly covered with an electron-emitting material.

10. A lighting system as claimed in claim 9, wherein a secondary winding of the double spiral of each electrode body comprises at least 8 turns.

11. A lighting system as claims in claim 6, wherein the lighting system is a compact fluorescent lamp comprising a housing which is secured to the low-pressure discharge lamp, the ionizable filling containing mercury and at least an inert gas, the discharge vessel being provided at an inner surface with a luminescent layer, the housing also being secured to a lamp cap having contacts, and the ballast circuit being accommodated in the housing and being electrically connected to the contacts and the current conductors.

* * * * *